United States Patent [19]
Rood
[11] 4,209,682
[45] Jun. 24, 1980

[54] LOW BOUNCE MOMENTARY CONTACT SWITCH

[76] Inventor: Robert M. Rood, 7164 Victoria Rd., St. Paul, Minn. 55119

[21] Appl. No.: 926,215

[22] Filed: Jul. 19, 1978

[51] Int. Cl.² ..... H01H 13/52
[52] U.S. Cl. ..... 200/159 R; 200/276
[58] Field of Search ..... 200/159 R, 276, 67 A, 200/67 R

[56] References Cited

U.S. PATENT DOCUMENTS

| | | | |
|---|---|---|---|
| 3,244,847 | 4/1966 | Erpel | 200/159 R |
| 3,767,878 | 10/1973 | Sykora | 200/159 R |
| 3,922,513 | 11/1975 | Kravchuck | 200/159 R |
| 3,946,181 | 3/1976 | Takamizawa et al. | 200/159 R |
| 3,949,181 | 4/1976 | Kempf | 200/159 R |
| 4,092,503 | 5/1978 | Raeder | 200/159 A |

*Primary Examiner*—Houston S. Bell, Jr.
*Attorney, Agent, or Firm*—Cushman, Darby & Cushman

[57] ABSTRACT

A momentary contact switch having low bounce switching characteristics achieved by maintaining a contact arm continuously biased in accordance with a predetermined force characteristic against a stationary conductor during a wiping contact. An embodiment utilizing a stationary primary contact and a unitary conductive spring contact disposed on a base, is disclosed. The unitary spring contact comprises a spring body portion arranged for compression along an axis normal to the base, and a contact arm portion extending transversely to the spring body portion. The primary contact includes a striking portion disposed at an angle with respect to the axis of compression disposed to cooperate in wiping contact with the contact arm as the spring body is compressed. The angular disposition of the striking plate causes the contact arm to be biased thereagainst with ever increasing force during the wiping contact.

20 Claims, 3 Drawing Figures

LOW BOUNCE MOMENTARY CONTACT SWITCH

The present invention relates to apparatus for making or breaking electrical contact in an electrical circuit, and more particularly, to a switch contact structure which exhibits an extremely low bounce switching characteristic, which is readily adaptable to high power applications such as in a 110 V power line, and a wide range of deflection pressures and travel lengths.

In many applications, pushbutton switches having extremely low bounce characteristics are desirable. For example, low bounce switches are typically utilized in highly sensitive integrated digital electronic circuits to ensure clean cut and decisive switching control in the circuit.

In general, low bounce dry circuit momentary contact switches are known. Examples of such switches are described in U.S. Pat. Nos. 3,244,847 issued Apr. 5, 1966 to Erpel, U.S. Pat. No. 3,949,181 issued Apr. 6, 1976 to D. R. Kempf, U.S. Pat. No. 3,946,181 issued Mar. 23, 1976 to Takamizawa et al and U.S. Pat. No. 3,767,878 issued Oct. 23, 1973 to A. J. Sykora.

The structures of the prior art switches, however, are typically subject to one or more of the following disadvantageous traits: compatibility with only relatively low power usages, i.e., in dry circuits; compatibility with only relatively limited ranges of travel distances and deflection pressures, unduly complex in structure, limited life cycle due to material fatigue, and unduly sensitive to shock.

The present invention provides a switch contact structure which is compatible with wide ranges of power, lengths of travel and pressure, exhibits an extremely low bounce characteristic, is substantially insensitive to shock, has an extremely long life cycle and is of particularly simple construction. In generaly, in accordance with the present invention, contact between first and second conductors is effected by a flexible contact arm which is adapted for movement along a predetermined path with respect to at least one of the conductors. The one conductor cooperates with the contact arm selectively providing a wiping contact. The one conductor is disposed at an angle to the path of travel of the contact arm to cause the contact arm to be biased against the conductor in accordance with a predetermined force characteristic throughout the wiping.

In the preferred embodiment, the contact structure utilizes only two elements disposed on a base: a conductive spring contact and a stationary primary contact. The unitary conductive spring includes a helical spring body portion and a contact arm portion. The spring body is adapted for compression along a given axis preferably normal to the base. The contact arm portion extends transversely to the axis of compression beyond the perimeter of the spring body. The bottom coil of the spring body is utilized as a secondary contact. The contact arm is preferably S-shaped extending longitudinally parallel to the spring body axis of compression and having a transversely disposed foot. The contact arm is formed of a portion of the top coil of the body with a crossarm member extending radially across the top of the spring body. The primary contact includes a striker plate portion disposed to cooperate in wiping contact with the foot of the contact arm when the spring body is compressed. The striker plate is set at a predetermined angle with respect to the travel of the contact arm to effect bias tension in accordance with a predetermined force characteristic. The depressing force is easily varied by changing the gauge or stiffness of the spring contact. Similarly, the power capacity of the switch can be controlled by the gauge of the spring contact. The length of travel to engagement is entirely flexible, and the structure can be adapted to nearly any style of mounting.

A preferred exemplary embodiment of a switch in accordance with the present invention will now be described in conjunction with the appended drawing wherein like numerals denote like elements and:

Figure 1:
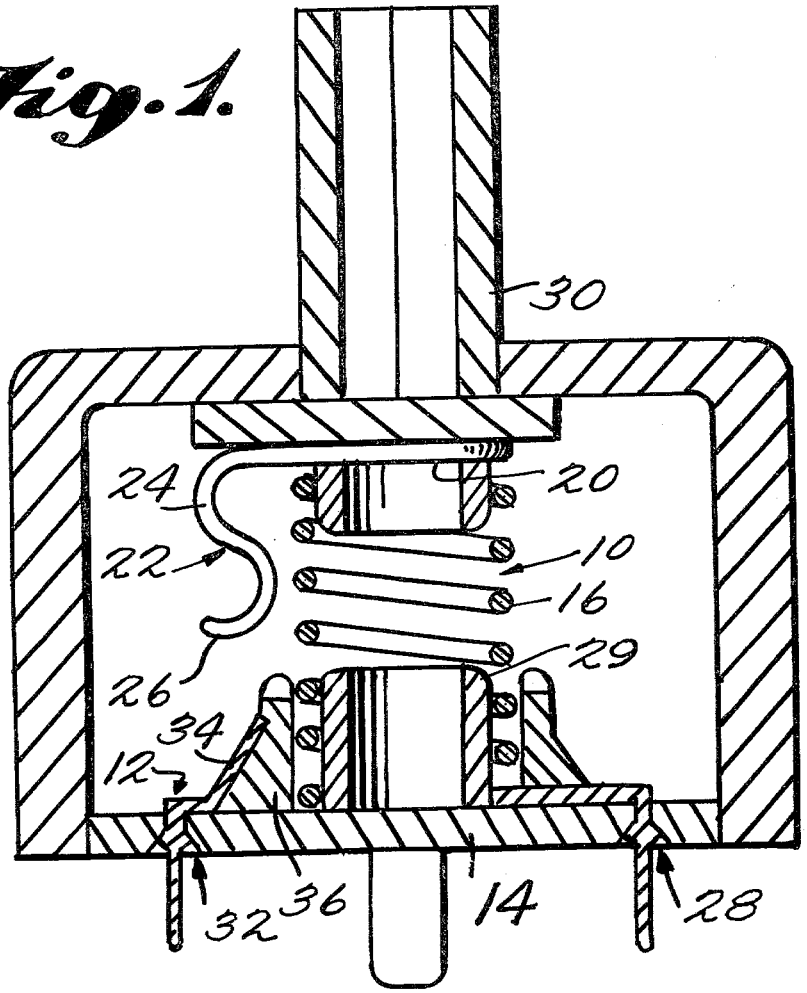
FIG. 1 is a sectional side view of a preferred exemplary embodiment of a contact structure in accordance with the present invention.
Figure 2:
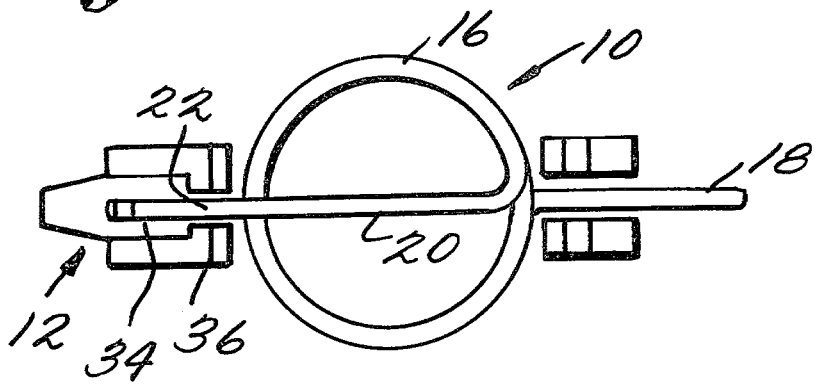
FIG. 2 is a top plane view of the spring contact and stationary contact of FIG. 1.

Referring now to FIGS. 1 and 2, there is shown a preferred exemplary contact structure comprising a unitary conductive spring contact, generally indicated as 10, and a stationary primary contact 12, both mounted on a nonconductive base 14.

Unitary spring contact 10 comprises a helical spring body portion 16, having end coils thereof modified to form a bottom extension 18 and crossarm member 20, respectively. Crossarm member 20 is bent from the uppermost coil of spring body 16 to extend radially (transversely) across the top of the spring body, preferably passing through the central longitudinal axis (axis of compress) of spring body 16. Crossarm member 20 extends radially beyond spring body 16 and is bent downwardly (towards base 14), to form a generally S-shaped or J-shaped contact arm 22. Contact arm 22 runs longitudinally, generally parallel to the axis of compression of spring body 16, and terminates in a foot 26 extending outwardly from spring body 16 in a radial (transverse) direction. Bottom extension 18 is similarly bent from the bottommost coil of spring body 16 to extend radially (transversely) out from the bottom of the spring body 16. Bottom extension 18 is in general alignment with crossarm 20, but originates from a point on spring body 16 on the opposite side of the central axis from the originating point of crossarm 20. Bottom extension 18 extends transversely beyond spring body 16 for a predetermined distance whereupon it is downwardly bent, to project through an aperture 28 in base 14 for use as a secondary contact.

Spring contact 10 is disposed on base 14 such that its axis of compression of spring body portion is generally normal to base 14. The disposition of spring body 16 on base 14 is suitably maintained by a central projection 29, passing centrally into spring body 16. While not so shown in the drawing, the height of projection 29 may be minimal, and in fact, can comprise a depression in base 14 for receiving spring body 16.

Primary contact 12 is disposed adjacent spring contact 10 having a portion passing through an aperture 32 in base 14 and including a generally planar shaped striker plate 34. Striking plate 34 is disposed, at a predetermined angle relative the axis of compression of spring body 16 and aligned with contact arm 22 so as to cooperate with the curved portion of foot 26 adjacent spring body 16. Striker plate 34 is suitably supported on a support member 36 affixed to base 14. Striker plate 34 suitably inclines in the direction approaching spring member 10 at an angle on the order of 30° with respect to the axis of compression (on the order of 60° from base member 14).

The upper coil of spring member 10, suitably cooperates with a pushbutton or actuation member generally indicated as 30. Actuator 30 suitably includes a slotted post extending into the center of spring body 16, slotted to accommodate and provide flexing clearance for crossarm member 20. As actuator 30 is depressed, compressing spring body 16, contact 22 is made to travel longitudinally along a predetermined path, generally parallel to the axis of compression. When foot portion 26 of contact arm 22 comes into contact with striker plate 34, a connection between the primary and secondary terminals is effected. As the travel continues, a wiping contact is effected between contact arm 22 and striker plate 34. As the spring depression is continued, the angular disposition of striker plate 34 causes contact arm 22 to be biased thereagainst with ever increasing force, maintaining against the striker plate continuous pressure and thereby providing an extremely low bounce switching characteristic.

In dry circuit applications with voltages up to on the order of 50 V, spring member 10 is suitably formed of 0.013 inch thick spring metal having a body radius on the order of 0.093 inches. Bottom extension 18 suitably extends outwardly beyond the outer perimeter of the bottom of body 16 on the order of 0.126 inches, whereupon it is bent downwardly to pass through aperture 28. Crossarm member 20 is suitably bent from the uppermost coil on the side of body 16 furthest striker plate 34, to a radius of curvature on the order of 0.030 inches, and extends transversely across the spring body and beyond the outer perimeter of spring body 16 on the order of 0.65 inches whereat it is bent downwardly to a radius of curvature on the order of 0.65 inches to form leg 24, generally parallel to the axis of compression. Foot 26 suitably is on the order of 0.075 inch transverse extent. Support 36 is suitably generally triangular in cross-section and includes a recess for receiving striker plate 34. Striker plate 34 is disposed, as noted above, at an angle on the order of 30° relative the axis of compression with topmost edge closest spring body 16 spaced on the order of 0.035 inches from the outer perimeter of spring body 16 and aligned to cooperate with the curved inner portion of foot 26 adjacent spring body 16.

It should be appreciated that in the normally-off contact structure of FIG. 1, spring body 16 provides a force which biases contact arm 22 away from (off of) striker plate 34. Conversely, once the bias of spring body 16 is overcome, contact arm 22 provides a biasing tension against striker plate 34. Utilization of a crossarm member 20 integral to and extending across the top of spring body 16 provides for transmission of the biasing tension on S-shaped member 22 through crossarm member 20 to spring body 16. As noted above, clearance for flexing of crossarm 20 is provided in the actuator 30 receiving slot. Transmission of the biasing tension to spring body 16 provides a consistent pressure (tension) characteristic for the biasing tension, and further, provides for extreme longevity of spring contact 10.

Figure 3:
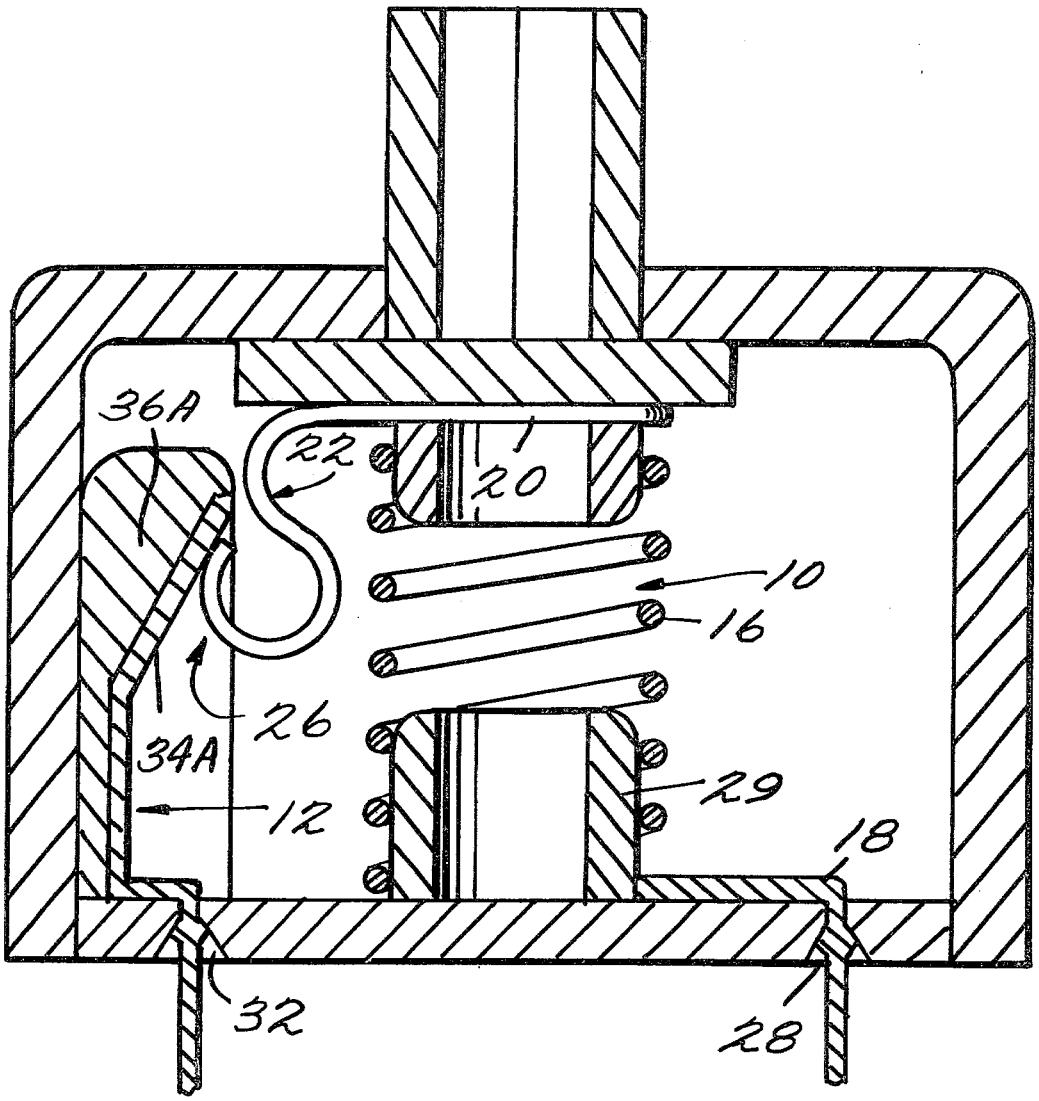
FIG. 3 is a sectional side view of a preferred exemplary embodiment of a normally on switch in accordance with the present invention.

The contact structure depicted in FIG. 1 provides for normally-off operation of the switch. The contact structure of the present invention can be, however, readily adapted to provide for normally-on operation, as shown in FIG. 3. Foot 26 of contact arm 22 is suitably bent to complete a half circle, and the curved outer portion of foot 26 (distal-proximate to spring body 16) cooperates with a striker plate 34A, fixed on a support 36A. Striker plate 34A is disposed with topmost edge closest contact arm 22 and extending downwardly at an angle on the order of 30° relative the axis of compression. Striker plate 34A is spaced apart from spring body 16 and aligned with contact arm 22 such that electrical contact is made when spring body 16 is uncompressed, with both spring body 10 and contact arm 22 providing forces biasing foot 26 against striker plate 34A. As spring body 16 is compressed, contact arm 22 continues to provide a force in accordance with a predetermined characteristic biasing foot 26 against striker plate 34, thereby effecting a wiping contact. After a predetermined length of travel has occurred, contact is broken between foot 26 and striker plate 36A. When actuator 30 is let up, allowing spring body 16 to expand back to its uncompressed state, the wiping contact is again controllably effected through the bias force of contact arm 22 to provide thereby a low bounce characteristic.

The switch contact structures illustrated in FIGS. 1, 2 and 3 are particularly advantageous in that it is compatible with high power applications and wide ranges of travel length and deflection pressure. The power rating of the switch is merely a function of the gauge of the spring utilized in forming spring contact 10. For example, a spring having a diameter of 0.012 of an inch is suitable for dry circuit operation up to approximately 50 V. By increasing the gauge of spring contact 10 to on the order of 0.020, the switch may be adapted for usage with typical 110 V applications. Similarly, the deflection pressure of the switch can be varied merely by changing the stiffness and/or guage of spring contact 10. The longitudinal extent of contact arm 22 can be varied to accommodate nearly any desired travel length. Thus, there are no inherent limitations on pre-contact travel in such a switch contact structure.

It should be appreciated that a plurality of spring members 10 can cooperate with a single planar striking plate to effect various switching combinations. Also, the unitary construction of spring contact 10 provides for ready adaptation of a plurality of switches in a single enclosure. More specifically, the switches can be mounted on a single unitary base member. Each spring contact 10 has associated therewith a separate pushbutton 30, which is suitably flanged and fits in an aperture in a face plate. No separate enclosures for the respective switches is necessary. Further, it has been found that this switching contact structure provides both tactile and audio feedback relative to engagement of the contacts.

It will be understood that the above description is of an illustrative embodiment of the present invention and that the invention is not limited to the specific forms shown. For example, contact arm 22 may be other than S-shaped or J-shaped, and while it is preferred that contact arm 22 be coupled to spring body 16 through a crossarm extending across the spring body, a contact arm extending directly outward from the side of a longitudinally disposed helical spring body nearest the primary contact may be utilized. Similarly, any form of mounting arrangement or base can be utilized. Other modifications may be made in the design and arrangement of the elements without departing from the spirit of the invention as expressed in the following claims.

What is claimed is:

1. In an apparatus for making or breaking electrical contact with low bounce switching characteristics in an electrical circuit said apparatus comprising first and second stationary electrical conductors, a conductive contact arm adapted for movement relative at least said first electrical conductor to selectively effect wiping electrical contact therewith to establish electrical connection between said first and second conductors, spring biasing means for biasing said contact arm with respect to said first electrical conductor; the improvement wherein:

said contact arm is adapted for flexing said first electrical conductor includes a striking portion disposed at a predetermined angle relative the direction of motion of said contact arm such that said contact arm during said wiping is continuously biased against said striking portion in accordance with a predetermined force characteristic.

2. The apparatus of claim 1 wherein said:

contact arm and spring biasing means comprise a unitary member, electrically connected to said second electrical conductor;

said unitary member being disposed adjacent said first conductor striking portion and including a helical spring body portion disposed for compression along an longitudinal axis substantially parallel to said direction of contact arm movement, said unitary member further comprising a contact arm portion extending transversely of said spring body portion.

3. The apparatus of claim 2 wherein said unitary member contact arm portion is generally S-shaped extending longitudinally generally parallel to the axis of compression of said spring body portion and a curved portion extending transversely from said spring body portion.

4. The apparatus of claim 3 wherein said contact arm portion extends from a crossarm member extending radially across said spring body portion from the side of said spring body portion opposite said first conductor.

5. Apparatus for making or breaking electrical contact with low bounce switching characteristics in an electrical circuit, said apparatus comprising:

a conductive spring member including a body portion adapted for compression along a predetermined longitudinal axis and a contact arm portion, said contact arm portion extending transversely of said body portion and, responsive to compression of said body portion, traveling along a predetermined path parallel said axis of compression; and a stationary electrical conductor, disposed adjacent said spring member to cooperate with said contact arm portion, said stationary conductor having a striking portion disposed relative said predetermined path of travel such that said contact arm portion makes wiping electrical contact with said striking portion during a predetermined portion of said travel and is continuously biased against said striking portion during said wiping, the force of said biasing being in accordance with a predetermined characteristic.

6. The apparatus of claim 5 wherein:

said contact arm portion comprises a generally S-shaped member extending longitudinally generally along the direction of said predetermined path of travel and a foot extending transverse to the direction of said predetermined path.

7. The apparatus of claim 5 wherein:

said S-shaped member is connected to said body portion through a crossarm member connected at one end to said S-shaped member extending radially across said body portion transverse to said axis of compression and connected at the other end to said body portion.

8. The apparatus of claims 2, 3 or 4 wherein said unitary member is formed of conductive material having a diameter in the range of 0.007 to 0.020 inches for dry circuit application.

9. The apparatus of claims 2, 3 or 4 wherein said unitary member is formed of conductive material having a diameter at least 0.020 inches for high voltage application.

10. The apparatus of claims 5, 6 or 7 wherein said spring member is formed of conductive material having a diameter in the range of 0.007 to 0.020 inches for dry circuit application.

11. The apparatus of claims 5, 6 or 7 wherein said spring member is formed of conductive material having a diameter at least 0.020 inches for high voltage application.

12. The apparatus of claim 3 adapted for use as a normally-off switch wherein:

said spring body normally biases said contact arm portion away from said striking portion; and said striking portion is disposed to cooperate with a surface of said curved portion adjacent said spring body.

13. The apparatus of claim 3 adapted for use as a normally-on switch wherein:

said spring body normally biases said contact arm portion into contact with said striking portion, and said striking portion is disposed to cooperate with a surface of said curved portion distal-proximate to said spring body.

14. The apparatus of claim 6 adapted for use as a normally-off switch wherein:

said spring member body portion biases said contact arm portion away from said striking portion; and said striking portion is disposed to cooperate with a surface of a curved portion of said foot adjacent said spring body.

15. The apparatus of claim 6 adapted for use as a normally-on switch wherein:

said spring member body portion biases said contact arm portion away from said striking portion; and said striking portion is disposed to cooperate with a surface of a curved portion of said foot adjacent said spring body.

16. The apparatus of claim 2 wherein said striking portion predetermined angle is within a plane containing both said helical spring longitudinal axis and the contact arm portion extending transversely of said spring body portion.

17. The apparatus of claim 5 wherein said striking portion is disposed at a predetermined angle to said predetermined path of said travel such that varying flexure of said contact arm portion is effected in accordance with said predetermined characteristic during the course of said wiping.

18. The apparatus of claim 17 wherein said predetermined path of travel is parallel to said spring member longitudinal axis and said predetermined angle is in a plane containing both said longitudinal axis and said predetermined path of travel.

19. The apparatus of claim 2 wherein said contact arm comprises a first portion extending transversely of said spring body portion, a second portion extending from said first transverse portion parallel to said direction of contact arm movement and a third portion extending transversely of said spring body portion parallel to said first transverse portion.

20. The apparatus of claim 19 wherein said striking portion is disposed to effect a varying flexure in accordance with said predetermined force characteristic of said contact arm within a plane containing both said first said transverse portion and said third transverse portion of said contact arm.

* * * * *